US008562297B2

(12) United States Patent
Yen et al.

(10) Patent No.: US 8,562,297 B2
(45) Date of Patent: Oct. 22, 2013

(54) CENTRIFUGAL FAN

(75) Inventors: Kevin Yen, Nagano (JP); Hiromitsu Kuribayashi, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 623 days.

(21) Appl. No.: 12/853,836

(22) Filed: Aug. 10, 2010

(65) Prior Publication Data

US 2011/0038743 A1 Feb. 17, 2011

(30) Foreign Application Priority Data

Aug. 11, 2009 (JP) ..... 2009-186666
Jul. 23, 2010 (JP) ..... 2010-166097

(51) Int. Cl.
*F04D 29/30* (2006.01)

(52) U.S. Cl.
USPC ..... 416/186 R; 416/223 B

(58) Field of Classification Search
USPC ..... 416/184 R, 186 R, 189, 223 B, 228; 415/119
See application file for complete search history.

(56) References Cited

U.S. PATENT DOCUMENTS 1,169,476 A * 1/1916 Gramlich ..... 416/186 R
3,221,398 A * 12/1965 Mayne ..... 29/889.4
6,739,835 B2 * 5/2004 Kim ..... 416/186 R
7,114,925 B2 * 10/2006 Shaw ..... 416/185
8,105,017 B2 * 1/2012 Dorsch et al. ..... 416/186 R

FOREIGN PATENT DOCUMENTS

JP 2940301 6/1999

* cited by examiner

*Primary Examiner* — Nathaniel Wiehe
*Assistant Examiner* — Brian O Peters
(74) *Attorney, Agent, or Firm* — Rankin, Hill & Clark LLP

(57) ABSTRACT

A curved portion is formed at a corner portion between a shroud and a positive pressure surface of each of a plurality of blades. The curved portion has a curvature that decreases from a suction port or the vicinity of the suction port toward a corresponding one of discharge ports. The curved portion includes a curved surface that is concave in a direction of rotation of the fan and forms a part of the positive pressure surface. The curved portion raised inwardly into an airflow path so that a shortest distance between the outer peripheral portion of a hub and a portion of the curved surface in the vicinity of the shroud may gradually decrease toward the corresponding one of the discharge ports.

3 Claims, 3 Drawing Sheets

CENTRIFUGAL FAN

TECHNICAL FIELD

The present invention relates to a centrifugal fan.

BACKGROUND ART

A centrifugal fan disclosed in Japanese Patent No. 2940301 includes an electric motor and an impeller coupled to the rotary shaft of the electric motor to rotate therewith. The impeller has a plurality of discharge ports for discharging air sucked through a suction port in a radial direction of the rotary shaft. The suction port is opened in an axial direction of the rotary shaft. The impeller further includes a hub coupled to the rotary shaft and extending in the radial direction of the rotary shaft, a shroud facing an outer peripheral portion of the hub and formed with the suction port at a central portion thereof, and a plurality of blades arranged between the outer peripheral portion of the hub and the shroud at intervals in a direction of rotation of the rotary shaft. Each of the discharge ports is formed between radially outer ends of adjacent two of the blades. Each of the blades includes a curved portion at a corner formed between a negative pressure surface thereof and the shroud in order to reduce noise. The curved portion has a curvature that increases from the suction port toward a corresponding one of the discharge ports. The structure of the centrifugal fan according to the related art, however, has a limit for reducing noise.

SUMMARY OF INVENTION

An object of the present invention is therefore to provide a centrifugal fan capable of reducing noise more than ever without reducing a static pressure value with respect to an airflow rate or airflow-static pressure characteristic, compared with centrifugal fans according to the related art.

A centrifugal fan, improvement of which is aimed at by the present invention, may comprise an electric motor and an impeller. The impeller is coupled to the rotary shaft of the electric motor to rotate therewith and has a suction port opened in an axial direction of the rotary shaft for sucking air and a plurality of discharge ports for discharging the sucked air in a radial direction of the rotary shaft. The impeller includes a hub, a shroud, and a plurality of blades. The hub is coupled to the rotary shaft and extends in the radial direction of the rotary shaft. The shroud faces an outer peripheral portion of the hub and is formed with the suction port at a central portion thereof. A plurality of blades are arranged between the outer peripheral portion of the hub and the shroud at intervals in a direction of rotation of the rotary shaft. Each of the discharge ports is formed between radially outer ends of adjacent two of the blades. In the present invention, each of the blades includes a curved portion or an R portion at a corner formed between a positive pressure surface thereof and the shroud. The curved portion or the R portion has a curvature that decreases from the suction port toward a corresponding one of the discharge ports. Specifically, the curved portion or the R portion is a raised portion that includes a curved surface curved to be concave in the direction of rotation and outwardly in the radial direction, that has the curvature that decreases from the suction port or from the vicinity of the suction port toward the corresponding one of the discharge ports, and that forms a part of the positive pressure surface.

An airflow path is formed by the outer peripheral portion of the hub, the positive pressure surface of one of the two adjacent blades, a negative pressure surface of the other of the two adjacent blades, and the shroud. In view of this airflow path, the curved portion is raised inwardly into the airflow path so that the shortest distance between the outer peripheral portion of the hub and a portion of the curved surface in the vicinity of the shroud may gradually decrease toward the discharge port.

If the curved portion or the R portion as described above is provided at the corner portion between the positive pressure surface and the shroud, noise may be reduced more than ever without reducing a static pressure, compared with centrifugal fans according to the related art. In the centrifugal fans according to the related art, a curved portion or an R portion is provided at a corner portion between a negative pressure surface and a shroud.

The inventors of the present invention have found a limit for reducing noise if the R portion is provided on the side of a negative pressure surface or a corner portion between the negative pressure surface and the shroud as in the centrifugal fans according to the related art. The inventors have then provided the curved portion or the R portion at the corner portion between the positive pressure surface and the shroud, though this structure is completely denied in view of the related art. The inventors have then carried out various experiments. As a result of the experiments, the inventors have found that if the R portion is provided at the corner portion between the positive pressure surface and the shroud, noise may be reduced more than ever without reducing a static pressure value with respect to an airflow rate or airflow-static pressure characteristic. The reason for this finding is that, when the curved portion or the R portion is provided at the corner portion between the positive pressure surface and the shroud, an air flow may be smoothed more than when the curved surface or the R portion is provided at the corner portion between the negative pressure surface and the shroud.

Preferably, a maximum curvature radius of the curved surface of the curved portion is determined to be not less than R4 but not more than R18. The maximum curvature radius means the curvature radius of a portion of the curved portion or the R portion that has a smallest curvature, and is the curvature radius of the curved portion or the R portion located nearest to the discharge port. The curvature of the curved portion or the R portion decreases toward the corresponding one of the discharge ports. If the maximum curvature radius is less than R4, noise may not sufficiently be reduced, compared with the centrifugal fans according to the related art. If the maximum curvature radius exceeds R18, air resistance of the discharge port will increase. Air cannot thereby be smoothly flown.

The blades extend inwardly in the radial direction beyond an inner peripheral edge portion of the shroud. That is, inner end portions of the blades extend into a space region facing the suction port. Preferably, the positive pressure surface excluding the curved surface is curved to be convex in the direction of rotation of the rotary shaft. With this arrangement, an increase in noise may be positively prevented.

BRIEF DESCRIPTION OF DRAWING

These and other objects and many of the attendant advantages of the present invention will be readily appreciated as the same becomes better understood by reference to the following detailed description when considered in connection with the accompanying drawings.

DESCRIPTION OF EMBODIMENTS

Figure 1:
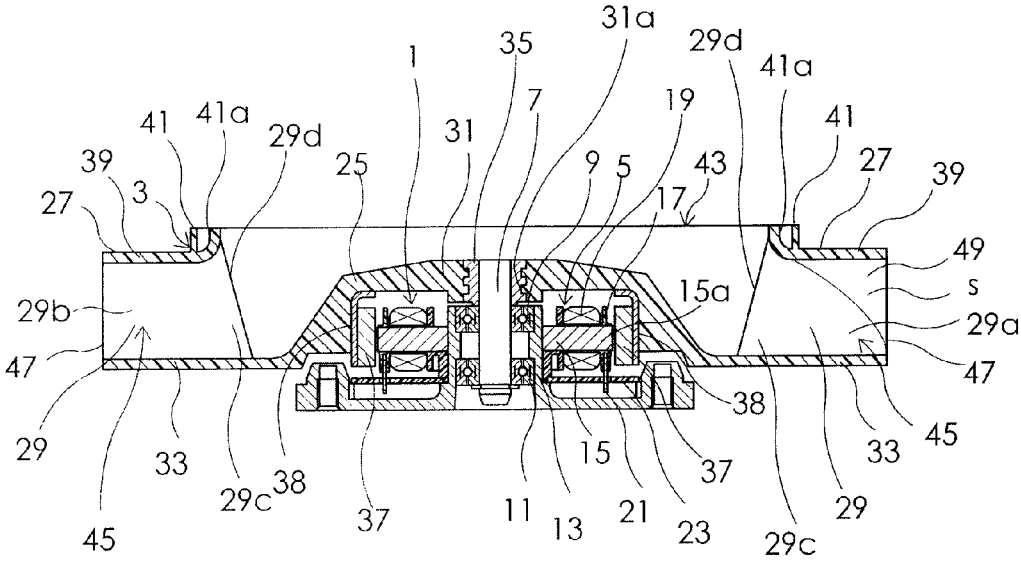
FIG. 1 is a sectional view of a centrifugal fan in an embodiment of the present invention.
Figure 2:
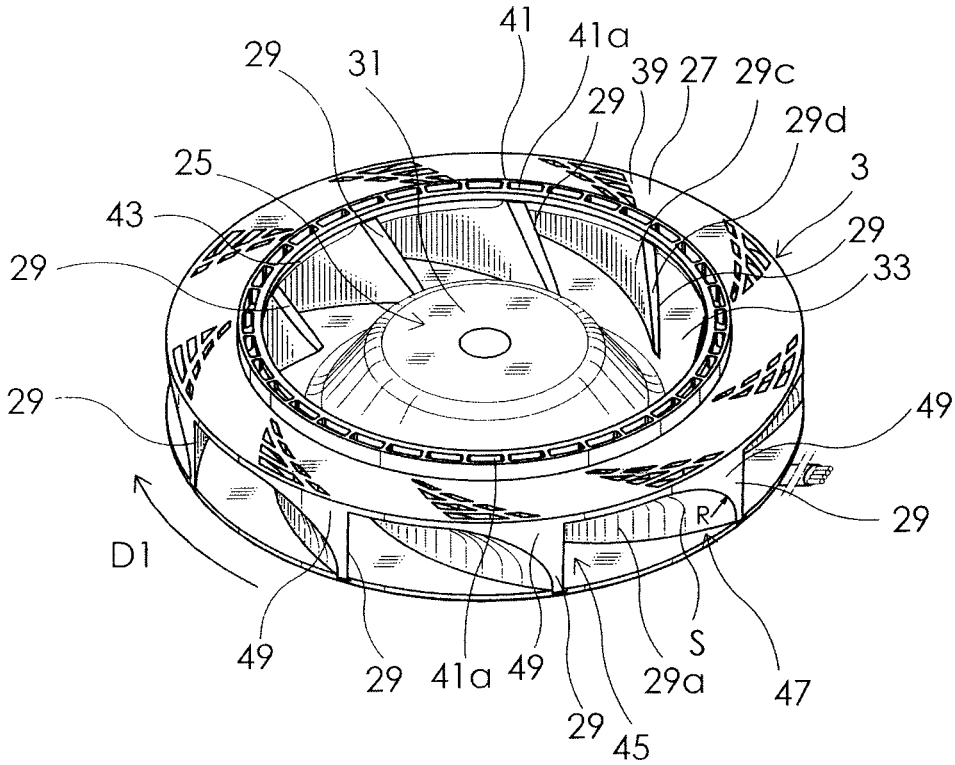
FIG. 2 is a perspective view of the centrifugal fan shown in FIG. 1.

An embodiment of the present invention will be described below in detail with reference to drawings. FIGS. 1 and 2 are respectively a sectional view and a perspective view of a centrifugal fan according to the embodiment of the present invention. As shown in FIG. 1, the centrifugal fan or sirocco fan in this embodiment comprises an electric motor 1 and an impeller 3. The electric motor 1 includes a stator 5 and a rotary shaft 7. The stator 5 is fitted outside a bearing holder 13. Two ball bearings 9 and 11 that rotatably support the rotary shaft 7 are fittedly held in the bearing holder 13. The stator 5 comprises a stator core 15 disposed outside the bearing holder 13, an insulator 17 made of an insulating resin and fitted in the stator core 15, and stator windings 19 wound around a plurality of salient-pole portions 15*a* of the stator core 15 through the insulator 17. The stator windings 19 are each electrically connected to a circuit pattern, not shown, on a circuit board 23 through a connecting conductor 21. A drive circuit is mounted on the circuit board 23 for feeding an exciting current to the stator windings 19.

The impeller 3 that is rotated by the electric motor 1 is unitarily formed of a synthetic resin. The impeller 3 comprises a hub 25, a shroud 27, and nine blades 29. The hub 25 includes a hub body 31 coupled to the rotary shaft and an annular plate portion 33 located on an outer periphery of the hub body 31. The hub body 31 is shaped like a cup and has a through hole 31*a* at a central portion thereof. A fall-off preventing cylindrical member 35 made of metal is fixed to the through hole 31*a* by an insert mold. The rotary shaft 7 is fixed to the cylindrical member 35 with one end thereof fitted into the cylindrical member 35. A yoke member 38 made of a magnetic material is fitted into an internal space of the hub body 31. In the yoke member 38, a plurality of permanent magnets 37 are fixed, facing the salient pole portions 15*a* of the stator core 15. With this arrangement, the impeller 3 rotates in a clockwise direction, indicated by an arrow D1, on the paper of FIG. 2, as a direction of normal rotation. The annular plate portion 33 is unitarily formed with the hub body 31, and extends from the hub body 31 in a radial direction of the rotary shaft 7.

The shroud 27 includes a shroud body 39 and an annular projecting portion 41. The shroud body 39 is shaped like an annular flat plate that is concentrically disposed with the rotary shaft 7. The shroud body 39 faces the outer peripheral portion or annular plate portion 33 of the hub 25. An opening portion formed at the central portion of the shroud body 39 constitutes a suction port 43. The annular projecting portion 41 is unitarily formed with an edge portion of the shroud body 39 on the side of the suction port 43. The annular projecting portion 41 projects in a direction apart from the annular plate 33 along an axial line of the rotary shaft 7. A plurality of concave portions 41*a* opened in a direction apart from the annular plate portion 33 are formed in the annular projecting portion 41. Balance weights are filled in these concave portions 41*a*, as necessary.

The nine blades 29 are arranged between the outer peripheral portion or annular plate portion 33 of the hub 25 and the shroud 27 at intervals in the direction of rotation of the rotary shaft 7. Each of the nine blades 29 has a positive pressure surface 29*a* as shown on the right side of the paper of FIG. 1 and a negative pressure surface 29*b* as shown on the left side of the paper of FIG. 1. The positive pressure surface 29*a* is a surface directed in the direction of rotation of the rotary shaft 7. The negative pressure surface 29*b* is a rear surface facing the positive pressure surface 29*a* in a direction of the thickness of the blade 29. In this embodiment, the positive pressure surface 29*a* is a curved surface that curves to be convex in the direction of rotation except a portion constituted from a curved surface S of a curved portion 49 that will be described later. The nine blades 29 each include an extended portion 29*c* that extends beyond an inner peripheral edge portion of the shroud 27, or a position of the annular projecting portion 41, inwardly in the radial direction. The extended portion 29*c* extends into a space region that communicates to the suction port 43. A surface 29*d* of the extended portion 29*c* directed to the suction port 43 constitutes an inclined surface that is inclined from the shroud 27 toward the annular plate portion 33 of the hub 25. With such an arrangement, an airflow path 45 is formed by the annular plate portion 33 of the hub 25, the positive pressure surface 29*a* of one of adjacent two of the blades 29, the negative pressure surface 29*b* of the other of the adjacent two of the blades 29, and the shroud 27. Each of the discharge ports 47 is formed between radially outer ends of adjacent two of the blades 29 or ends located outwardly in the radial direction of the airflow path 45.

When the impeller 3 is rotated by the electric motor 1 in this centrifugal fan, air sucked through the suction port 43 is discharged by the nine blades 29 from nine discharge ports 47 in the radial direction of the rotary shaft 7 through nine airflow paths 45. The suction port 43 is opened in the axial direction of the rotary shaft 7.

The nine blades 29 each include a curved portion or an R portion 49 at a corner formed between the positive pressure surface 29*a* and the shroud 27. The curved portion has a curvature that decreases toward a corresponding one of the discharge ports 47. The curved portion 49 includes a curved surface S that is curved to be concave in the direction of rotation and outwardly in the radial direction, and forms a part of the positive pressure surface. In other words, the curved portion 49 is raised inwardly into the airflow path 45 so that the shortest distance between the outer peripheral portion of the hub 25 and a portion of the curved surface S in the vicinity of the shroud 27 may gradually decrease toward the discharge port 47. The curved surface S of the curved portion 49, located on the side of the airflow path 45, forms a part of the positive pressure surface 29*a*. The sectional contour of the curved surface S, namely, a portion facing the airflow path 45, as the curved portion 49 is sectioned in a direction orthogonal to the direction of rotation, is constituted from a linear line segment and a curved line segment in a location distant from the discharge port 47. The linear line segment gradually decreases toward the discharge port 47 while the curved line segment gradually increases toward the discharge port 47. Then, in the vicinity of the discharge port 47, the contour is constituted from the curved line segment alone. The curved line segment is shaped substantially like a circular arc. The curvature of the circular arc decreases toward a corresponding one of the discharge ports 47. In this embodiment, a curvature radius or minimum curvature radius in the vicinity of the suction port 43 is R0, while a curvature radius or maximum curvature radius at the suction port 47, indicated by reference character R shown in FIG. 2, is R18 or 18 mm in curvature radius.

Figure 3:
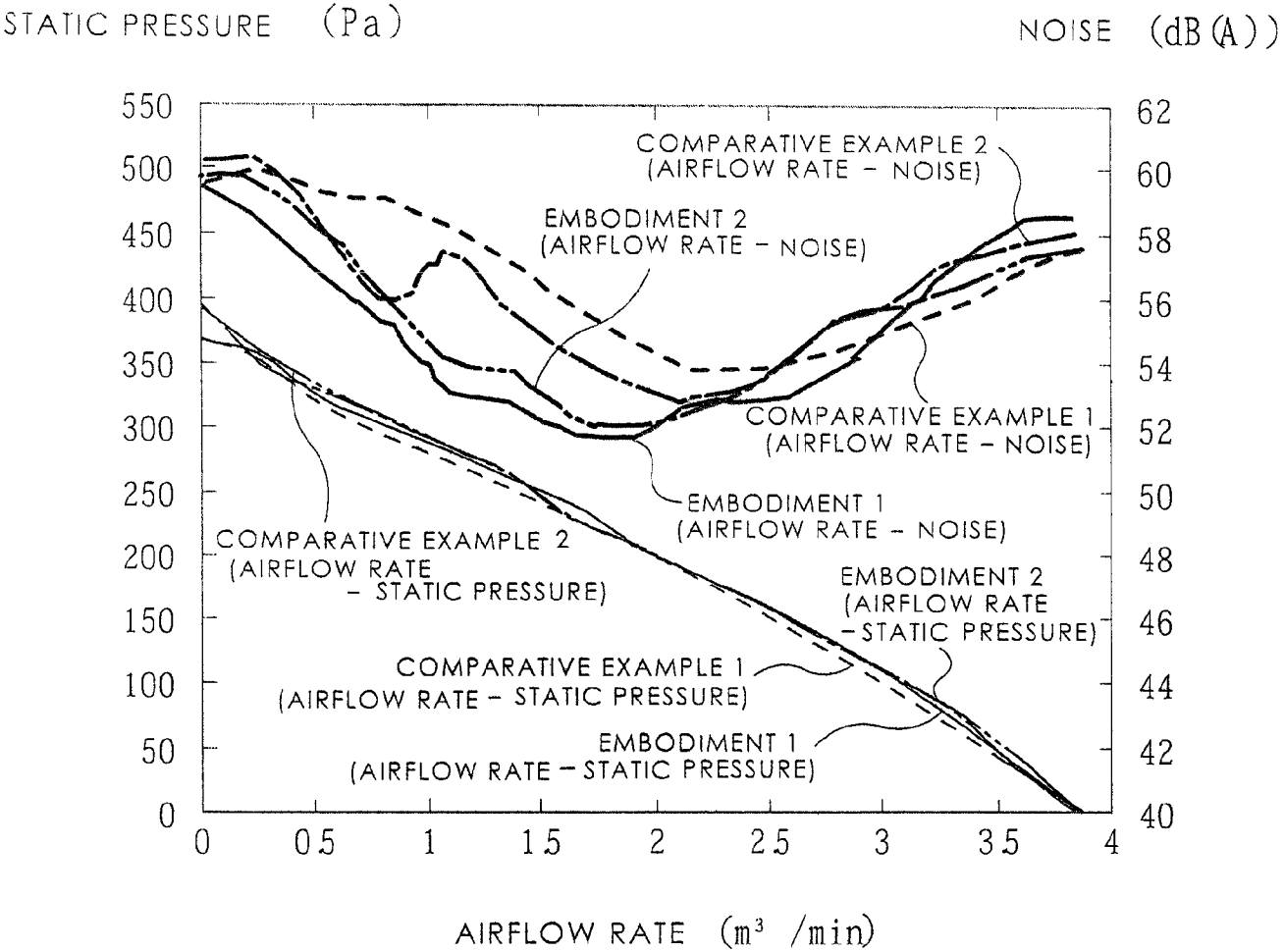
FIG. 3 is a graph showing a relationship between an airflow rate and a static pressure and a relationship between the airflow rate and noise in respect of each centrifugal fan used in tests.

Next, a centrifugal fan in Embodiment 1, a centrifugal fan in Embodiment 2, and centrifugal fans in Comparative Examples 1 and 2 were used to carry out tests. The centrifugal fan in Embodiment 1 is the centrifugal fan described above having the maximum curvature of R18. The centrifugal fan in Embodiment 2 has a curvature radius or maximum curvature radius of R4 at a discharge port. Except that respect, the centrifugal fan Embodiment 2 has the same structure as the centrifugal fan in Embodiment 1. The centrifugal fan in Comparative Example 1 has no curved portion or an R portion at a corner portion between a positive pressure surface and a shroud. Except that respect, the centrifugal fan in Comparative Example 1 has the same structure as the centrifugal fan in Embodiment 1. In the centrifugal fan of Comparative Example 2, no curved portion or an R portion is provided at a corner portion between a positive pressure surface and a shroud, but a curved portion or an R portion having a maximum curvature radius of R4 is provided at a corner portion between a negative pressure surface and the shroud. Except that respect, the centrifugal fan in Comparative Example 2 has the same structure as the centrifugal fan in Embodiment 1. The centrifugal fans in Embodiments 1 and 2 and Comparative Examples 1 and 2 were rotated at 3700 rpm, and a relationship between an airflow rate and a static pressure and a relationship between the airflow rate and noise were then examined in respect of each fan used in the tests. FIG. 3 shows results of measurement of the tests.

A horizontal axis of FIG. 3 indicates the airflow rate ($m^3$/min), a vertical axis on the left side of the paper of FIG. 3 indicates the static pressure (Pa), and a vertical axis on the right side of the paper of FIG. 3 indicates the noise (dB(A)). It can be seen from FIG. 3 that the centrifugal fans in Embodiments 1 and 2 having the maximum curvature radii of R18 and R4, respectively and Comparative Examples 1 and 2 have substantially a same static pressure value with respect to the airflow rate or airflow-static pressure characteristic. In contrast therewith, it can be seen that the centrifugal fans in Embodiments 1 and 2 may reduce noise more than the centrifugal fans in Comparative Examples 1 and 2. It can be seen in particular that the centrifugal fan in Embodiment 2, indicated by a chain double-dashed line, having the curved portion or the R portion with the maximum curvature radius of R4 on the side of the positive pressure surface may reduce noise more than the centrifugal fan in Comparative Example 2, indicated by a dashed line, having the curved portion or the R portion with the maximum curvature of R4 on the side of the negative pressure surface.

INDUSTRIAL APPLICABILITY

According to the present invention, noise may be reduced more than in centrifugal fans according to the related art, without reducing a static pressure value with respect to an airflow rate or airflow-static pressure characteristic. Noise may be reduced more than in the centrifugal fans according to the related art, in particular those having a curved portion or an R portion on the side of a negative pressure surface at a corner portion between the negative pressure surface and a shroud.

While certain features of the invention have been described with reference to example embodiments, the description is not intended to be construed in a limiting sense. Various modifications of the example embodiments, as well as other embodiments of the invention, which are apparent to persons skilled in the art to which the invention pertains are deemed to lie within the spirit and scope of the invention.

What is claimed is:

1. A centrifugal fan comprising:

an electric motor including a rotary shaft; and an impeller coupled to the rotary shaft of the electric motor to rotate therewith and having a suction port opened in an axial direction of the rotary shaft for sucking air and a plurality of discharge ports for discharging the sucked air in a radial direction of the rotary shaft, the impeller including:

a hub coupled to the rotary shaft and extending in the radial direction of the rotary shaft;

a shroud facing an outer peripheral portion of the hub and formed with the suction port at a central portion thereof; and a plurality of blades arranged between the outer peripheral portion of the hub and the shroud at intervals in a direction of rotation of the rotary shaft, wherein:

each of the discharge ports is formed between radially outer ends of adjacent two of the blades;

each of the blades includes a curved portion at a corner formed between a positive pressure surface thereof and the shroud, the curved portion having a curvature that gradually decreases toward a corresponding one of the discharge ports;

the curved portion includes a curved surface that is curved to be concave in the direction of rotation and outwardly in the radial direction, and forms a part of the positive pressure surface;

an airflow path is formed by the outer peripheral portion of the hub, the positive pressure surface of one of the two adiacent blades, a negative pressure surface of the other of the two adiacent blades, and the shroud;

a sectional contour of the curved surface, as the curved portion is sectioned in a direction orthogonal to the direction of rotation, is constituted from a linear line segment and a curved line segment in a location distant from the discharge port;

the linear line segment gradually decreases toward the discharge port while the curved line segment gradually increases toward the discharge port; and in the vicinity of the discharge port, the sectional contour of the curved surface is constituted from the curved line segment alone.

2. The centrifugal fan according to claim 1, wherein a maximum curvature radius of the curved surface is determined to be not less than 4 mm in curvature radius but not more than 18 mm in curvature radius.

3. The centrifugal fan according to claim 1, wherein:

the blades extend inwardly in the radial direction beyond an inner peripheral edge portion of the shroud; and the positive pressure surface excluding the curved surface is curved to be convex in the direction of rotation of the rotary shaft.

* * * * *